US008512122B2

(12) United States Patent
Kula

(10) Patent No.: US 8,512,122 B2
(45) **Date of Patent: *Aug. 20, 2013**

(54) ELECTRONIC DELIVERY OF GAMING TICKETS

(75) Inventor: Miroslaw Kula, Cranston, RI (US)

(73) Assignee: Spielo International Canada, ULC, Moncton, New Brunswick (CA)

( * ) Notice: Subject to any disclaimer, the term of this patent is extended or adjusted under 35 U.S.C. 154(b) by 308 days.

This patent is subject to a terminal disclaimer.

(21) Appl. No.: 12/898,117

(22) Filed: Oct. 5, 2010

(65) Prior Publication Data

US 2011/0021258 A1 Jan. 27, 2011

Related U.S. Application Data

(63) Continuation of application No. 10/400,101, filed on Mar. 26, 2003, now Pat. No. 7,828,650.

(51) Int. Cl.
*A63F 9/24* (2006.01)

(52) U.S. Cl.
USPC ..... 463/17; 463/29

(58) Field of Classification Search
USPC ..... 463/17, 29
See application file for complete search history.

(56) References Cited

U.S. PATENT DOCUMENTS

| | | | |
|---|---|---|---|
| 4,108,361 | A | 8/1978 | Krause |
| 4,716,799 | A | 1/1988 | Hartmann |
| 4,918,690 | A | 4/1990 | Markkula et al. |
| 4,957,340 | A | 9/1990 | Kirkby |
| 4,972,463 | A | 11/1990 | Danielson et al. |
| 5,161,153 | A | 11/1992 | Westmore |
| 5,239,662 | A | 8/1993 | Danielson et al. |
| 5,256,863 | A | 10/1993 | Ferguson et al. |
| 5,544,164 | A | 8/1996 | Baran |
| 5,559,794 | A | 9/1996 | Willis et al. |
| 5,577,105 | A | 11/1996 | Baum et al. |
| 5,761,647 | A | 6/1998 | Boushy |
| 6,067,527 | A | 5/2000 | Lovell et al. |
| 6,072,806 | A | 6/2000 | Khouri et al. |
| 6,104,815 | A | 8/2000 | Alcorn et al. |
| 6,146,272 | A | 11/2000 | Walker et al. |
| 6,183,362 | B1 | 2/2001 | Boushy |
| 6,272,529 | B1 | 8/2001 | Lum |
| 6,333,975 | B1 | 12/2001 | Brunn et al. |
| 6,335,927 | B1 | 1/2002 | Elliott et al. |
| 6,366,893 | B2 | 4/2002 | Hannula et al. |
| 6,426,952 | B1 | 7/2002 | Francis et al. |
| 6,546,441 | B1 | 4/2003 | Lum |
| 6,654,784 | B1 | 11/2003 | Wei |
| 6,678,268 | B1 | 1/2004 | Francis et al. |
| 6,682,423 | B2 | 1/2004 | Brosnan et al. |
| 6,699,125 | B2 | 3/2004 | Kirmse et al. |

(Continued)

FOREIGN PATENT DOCUMENTS

| | | | |
|---|---|---|---|
| FR | 2 815 214 | A | 4/2002 |
| WO | WO 01/03786 | A | 1/2001 |
| WO | WO 02/054355 | A | 7/2002 |

*Primary Examiner* — Pierre E Elisca
(74) *Attorney, Agent, or Firm* — Sullivan & Worcester LLP; Christopher T. McWhinney

(57) ABSTRACT

Systems and methods of generating electronic gaming tickets provide for receiving an asynchronous reply from an access device over a network. An electronic gaming ticket is sent toward the access device over the network based on the asynchronous reply. By providing asynchronous communication with the access device, a number of advantages are achieved.

26 Claims, 6 Drawing Sheets

(56) References Cited

U.S. PATENT DOCUMENTS

| | | | | |
|---|---|---|---|---|
| 6,719,631 | B1 * | 4/2004 | Tulley et al. | 463/17 |
| 6,745,259 | B2 | 6/2004 | Wagner | |
| 6,802,505 | B2 | 10/2004 | Jeon | |
| 2001/0020228 | A1 | 9/2001 | Cantu et al. | |
| 2001/0036853 | A1 | 11/2001 | Thomas | |
| 2002/0120554 | A1 | 8/2002 | Vega | |
| 2002/0165023 | A1 | 11/2002 | Brosnan et al. | |
| 2003/0023547 | A1 | 1/2003 | France et al. | |
| 2003/0064807 | A1 | 4/2003 | Walker et al. | |
| 2003/0069053 | A1 | 4/2003 | Dovgan | |
| 2003/0120597 | A1 | 6/2003 | Drummond et al. | |
| 2003/0144915 | A1 | 7/2003 | Aupperle et al. | |
| 2003/0162580 | A1 | 8/2003 | Cousineau et al. | |
| 2003/0228910 | A1 | 12/2003 | Jawaharlal et al. | |
| 2004/0090450 | A1 | 5/2004 | Gill et al. | |
| 2004/0111369 | A1 | 6/2004 | Lane et al. | |
| 2004/0235542 | A1 | 11/2004 | Stronach et al. | |
| 2005/0107162 | A1 * | 5/2005 | Kilby et al. | 463/42 |
| 2009/0023490 | A1 * | 1/2009 | Moshal et al. | 463/17 |
| 2009/0093300 | A1 * | 4/2009 | Lutnick et al. | 463/26 |
| 2009/0104965 | A1 * | 4/2009 | House et al. | 463/20 |
| 2010/0048302 | A1 | 2/2010 | Lutnick et al. | |
| 2010/0113124 | A1 * | 5/2010 | Amirsadri et al. | 463/17 |

* cited by examiner

32'

From: offers@atlantis.state.lottery.org
To: john.doe@jkjhg.com
Subject: Atlantis State Lottery THE JACKPOT for the Atlantis State Lottery is up to $105M!

35

Reply to participate in the drawing on Wednesday, Jan. 15, 2003. If you have numbers you want to play, include them in the reply. Otherwise, the system will pick numbers for you.

GOOD LUCK!

Offer# 011503-326887

33

ELECTRONIC DELIVERY OF GAMING TICKETS

CROSS-REFERENCE TO RELATED APPLICATIONS

This application is a continuation of U.S. patent application Ser. No. 10/400,101, filed Mar. 26, 2003. The entire content of the original disclosure of said application is expressly incorporated herein in its entirety by reference thereto.

BACKGROUND

1. Technical Field

Embodiments of the present invention generally relate to gaming systems. More particularly, embodiments relate to electronic delivery of gaming tickets in an asynchronous environment.

2. Discussion

Gaming systems such as future draw and instant lotteries continue to grow in popularity. Traditionally, such gaming systems have been implemented in a point-of-sale environment in which the user or consumer purchases a physical gaming ticket in person. More recent approaches, however, have implemented such systems in an online environment in which the consumer uses a networked computer to access a server that functions as a gaming system. While conventional online gaming systems have been effective under certain circumstances, a number of difficulties remain.

A particular difficulty results from the synchronous nature of conventional online gaming systems. For example, a number of web sites contain invitations to participate in one or more games. While visiting the site, the user can reply instantaneously to the invitation according to a synchronous, or session-based, transaction protocol such as the well documented hypertext transfer protocol (HTTP). The term "session" is used herein to describe a lasting connection between a user (or user agent) and a peer, which is typically a server. The connection usually involves the exchange of many packets between the user's computer and the server. A session is sometimes implemented as a layer in a network protocol (e.g., telnet, file transfer protocol/FTP). In the case of protocols where there is no concept of a session layer or where sessions at the session layer are generally short-lived (e.g., HTTP), "virtual" sessions are implemented by having each exchange between the user and the remote most include some form of cookie, which stores state information. State information may include a unique session identifier, information about the user's preferences or authorization, etc.

In any event, session-based protocols typically involve the synchronous transfer of information between the user's computer and the server. For example, in online gaming systems, the server might send a web page to a user over the network connection, where the web page contains an invitation to purchase a gaming ticket. If the user agrees, a synchronous reply is sent back to the server over the network during the session between the user terminal and the server. Unfortunately, synchronous transactions require a relatively high amount of attention from the user because the user must participate in a session in order to complete a given transaction. For example, the user must typically locate the web site and navigate through the various pages required in order to reply to the invitation. Indeed, it has proven to be quite difficult to attract users to a given gaming web site in the first place. Furthermore, it has been determined that synchronous transactions and session-based transaction protocols can be intimidating to users, particularly in the gaming context. There is therefore a need to provide for the generation of electronic gaming tickets in a manner that does not have the shortcomings associated with synchronous communication and session-based transaction protocols.

While certain approaches such asynchronous subscription services have been developed in the gaming context, a number of difficulties still remain. For example; the typical asynchronous subscription service permits The user to select numbers to be played on a regular basis. The invitation to participate as well as the reply to the invitation can be transmitted according to a stand-alone transaction protocol such as an email protocol, and therefore may be considered to be asynchronous in nature. Such a service does not, however, send an electronic gaming ticket to the user. As a result, subscription based gaming systems do not simulate the traditional playing of a gaming system and have been determined to often lack the desired level of excitement to achieve widespread popularity among consumers. There is therefore a need for a gaming system that is asynchronous in nature and more closely simulates the playing of a gaming system in a traditional environment.

BRIEF DESCRIPTION OF THE DRAWINGS

The various advantages of the embodiments of the present invention will become apparent to one skilled in the art by reading the following specification and appended claims, and by referencing the following drawings, in which:

DETAILED DESCRIPTION

Figure 1:
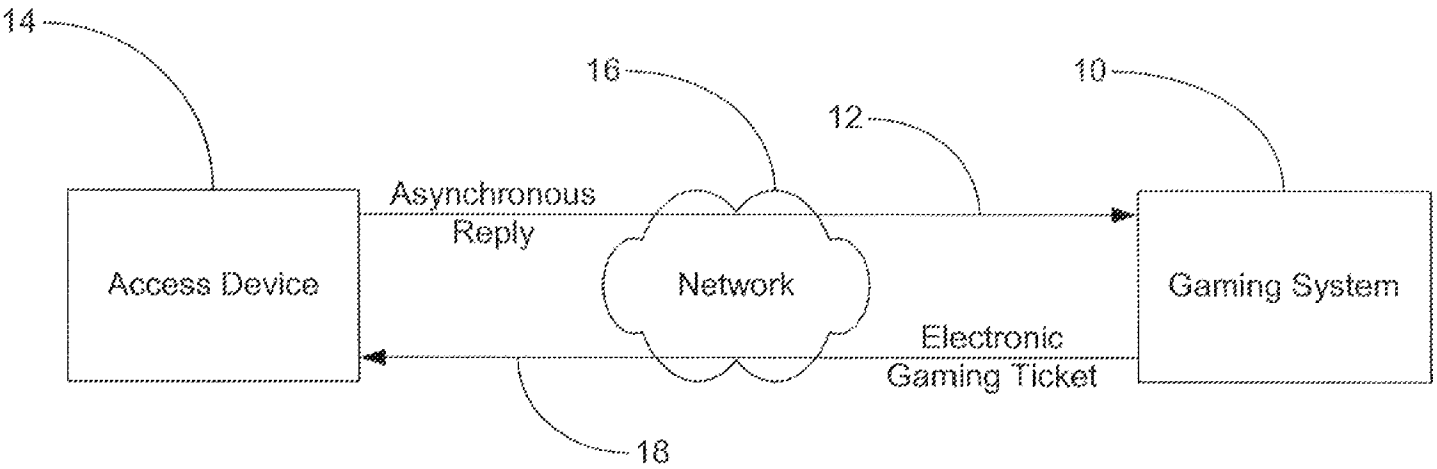
FIG. 1 is a block diagram of a gaming system according to one embodiment of the invention.

Embodiments of the present invention generally provide for the generation of electronic gaming tickets such as future draw lottery tickets and instant lottery tickets, in a manner that enables the user to participate outside the traditional confines of session-based transaction protocols. For example, permitting the user to generate an asynchronous reply such as an email reply or an instant messaging (IM) reply results in a gaming environment that is based on standalone transactions. The result is a framework that does not have to be instantaneous in nature, and is therefore less intimidating than conventional approaches. Indeed, under certain embodiments, the user may wait days, weeks, months, etc. before deciding to purchase the gaming ticket. By way of example, FIG. 1 shows a gaming system 10 that can be configured to receive an asynchronous reply 12 from a access device 14 such as a personal computer (PC), personal digital assistant (PDA), cellular phone or other computing device over a network 16, and to send an electronic gaming ticket 18 toward the access device 14 over the network 16 based on the asynchronous reply 12. Alternatively, the gaming system 10 may store the gaming ticket 18 to a profile associated with the user for later viewing by the user. In this regard, the decision as to whether to send the gaming ticket 18 or to store it can be configurable. By generating the electronic gaming ticket 18 based on an asynchronous reply 12, gaming system 10 provides substantial advantages over conventional gaming systems.

As will be discussed in greater detail below, the asynchronous reply 12 is sent by the access device 14 in response to an asynchronous invitation (not shown). In this regard, the gaming system 10 is adapted to confirm that the invitation being responded to is still valid before issuing the electronic gaming ticket 18. Furthermore, in a non-anonymous gaming environment, transaction non-repudiation can be achieved through player authentication. Indeed, data privacy, authentication and data integrity can all be adopted based on evolving standards. For example, public key infrastructure (PKI) communications deal with extensible markup language (XML, 1.0, Second Edition, W3C, Oct. 6, 2000) document exchange security under the web security umbrella, and can be used to support gaming system 10. Some XML related security standards are XML encryption (Xenc, W3C Candidate Recommendation for XML Encryption Syntax and Processing, March 2002), XML signatures (XML-SIG, W3C Candidate Recommendation for XML Signature Syntax and Processing, February 2002), XML key management specification (XKMS, W3C Working Draft for XML Key Management (2.0) Requirement, March 2002), eXtensible accessible control markup language (XACML 1.0 Specification Set, OASIS Open Standard, February 2003) and Security Assertion Markup Language (SAML 1.0 Specification Set, OASIS Standard, November 2002). Thus, all relevant security facets—authentication, data privacy, data integrity, and non-repudiation—can be addressed via standard technologies and services including, but not limited to, digital certificates and PKI.

Figure 2:
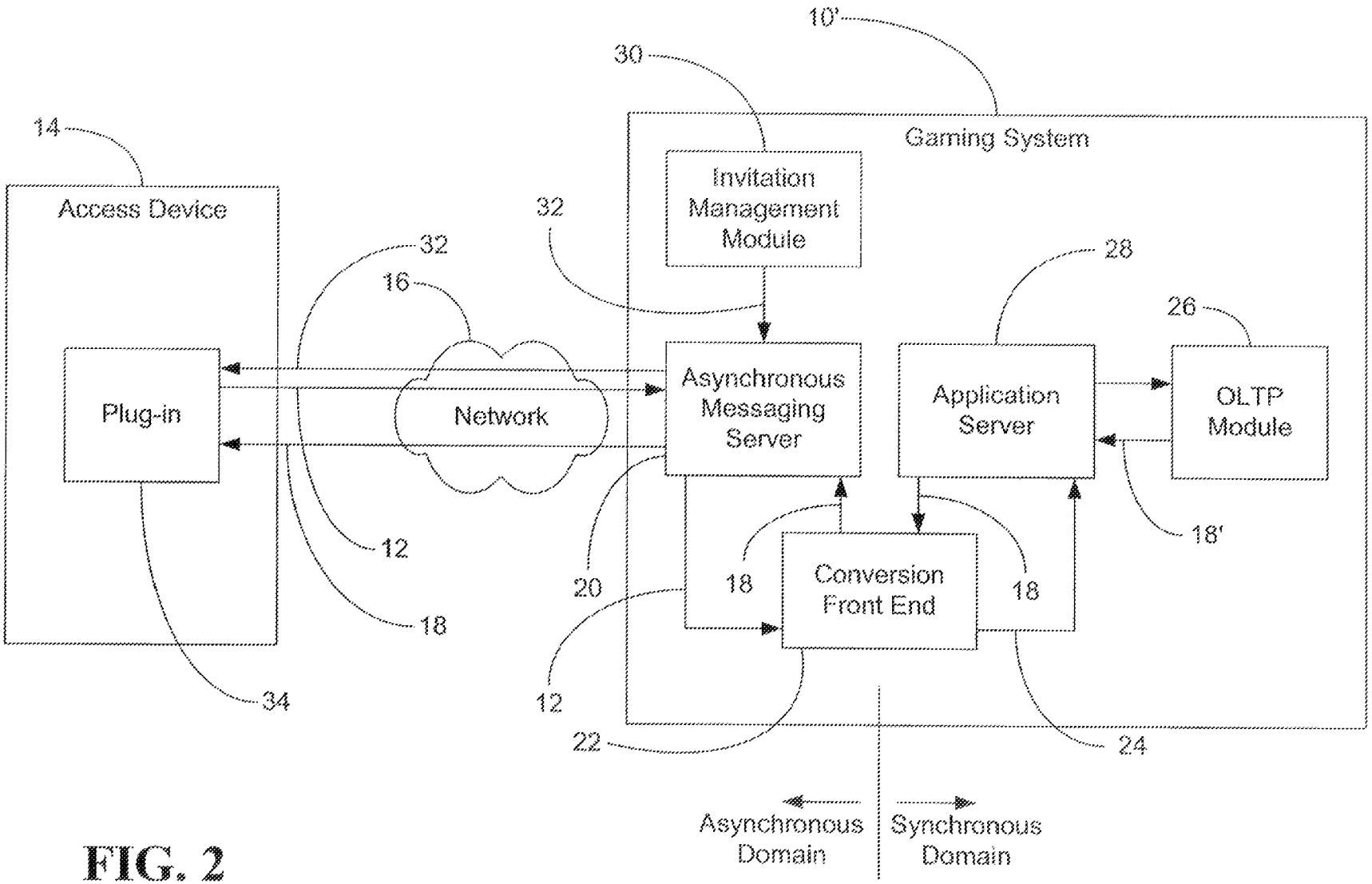
FIG. 2. is a block diagram of a gaming system according to a first alternative embodiment of the invention.

Turning now to FIG. 2, one approach to a gaming system is shown in greater detail at 10'. Specifically, gaming system 10' has an asynchronous messaging server 20 that receives asynchronous reply 12 from the access device 14 over the network 16 and sends the electronic gaming ticket 18 toward the access device 14 over the network 16 based on the asynchronous reply 12.

An invitation management module 30 is coupled to the asynchronous messaging server 20, where the invitation management module 30 generates an asynchronous invitation 32 to participate in the particular game being implemented. The asynchronous messaging server 20 forwards the asynchronous invitation 32 toward a plug-in 34 of the access device 14, where the asynchronous invitation 32 serves as the basis for the asynchronous reply 12. The asynchronous invitation 32 can be configured as a "play slip", which is essentially a form that the user can either accept as-is, or fill out with the pertinent gaming information. It is important to note that the invitation 32 and the gaming ticket 18 are different in that the gaming ticket is a "user friendly" representation of the wager, whereas the invitation 32 is a mere offer to play.

A conversion front end 22 is coupled to the asynchronous messaging server 20, and converts the asynchronous reply 12 into a synchronous ticket request 24. The conversion front end 22 uses the synchronous ticket request 24 to obtain electronic gaming ticket 18 and the asynchronous messaging server 20 forwards electronic gaming ticket 18 toward the access device 14 according to a standalone transaction protocol such as an email protocol or instant messaging (IM) protocol. Thus, the conversion front end 22 functions as an interface between an asynchronous domain and a synchronous domain as illustrated.

An online transaction processing (OLTP) module 26 generates electronic gaming ticket 18', where an application server 28 is coupled to the conversion front end 22 and the OLTP module 26. The application server 28 retrieves the electronic gaming ticket 18' from the OLTP module 26 according to the session-based transaction protocol. The application server 28 and OLTP module 26, as well as the associated session-based transaction protocol, can be implemented in the Enterprise Series (ES) system platform available from GTech Rhode Island Corporation in West Greenwich, R.I. The application server 28 can be implemented as primarily middleware software, such as Java® code running on a Java® 2 Platform, Enterprise Edition (J2EE) compliant server, working together with compatible components, such as a Prosys® transaction engine. Although such an approach would enable "mass marked" users to access the system via consumer style devices such as PCs or PDAs, other techniques can be used. For example, Altura® terminals, which are agent-operated and dedicated terminals, could also be used as access devices.

The application server 28 is able to format the electronic gaming ticket 18 with a commercially available markup language such as the extensible markup language (XML). Since markup languages are a flexible way to create common information formats using well defined transformation tools, the electronic gaming ticket 18 can be given a "look and feel" that is similar to that of a traditional paper gaming ticket. Markup language formatted electronic gaming tickets can also be readily shared among computers connected to the network 16. Indeed, the asynchronous invitation 32 and asynchronous reply 12 may also be formatted with the appropriate language markup. It should be noted that the gaming ticket 18 may be a lottery ticket such as a future draw lottery ticket. Other types of gaming tickets include instant lottery tickets and promotional tickets of the "peel-off" variety commonly used by restaurant chains and other businesses. In the case of a future draw lottery ticket, the drawing numbers may be defined by the asynchronous reply 12 (i.e., the user selects the drawing numbers) or by the OLTP module 26 (i.e., the gaming system selects the drawing numbers). Although the application server 28 is shown as formatting the electronic gaming ticket 18 with the markup language, such formatting may also be implemented in the conversion front end 22 or OLTP module 26 without parting from the spirit and scope of the embodiments of the invention.

Figure 3:
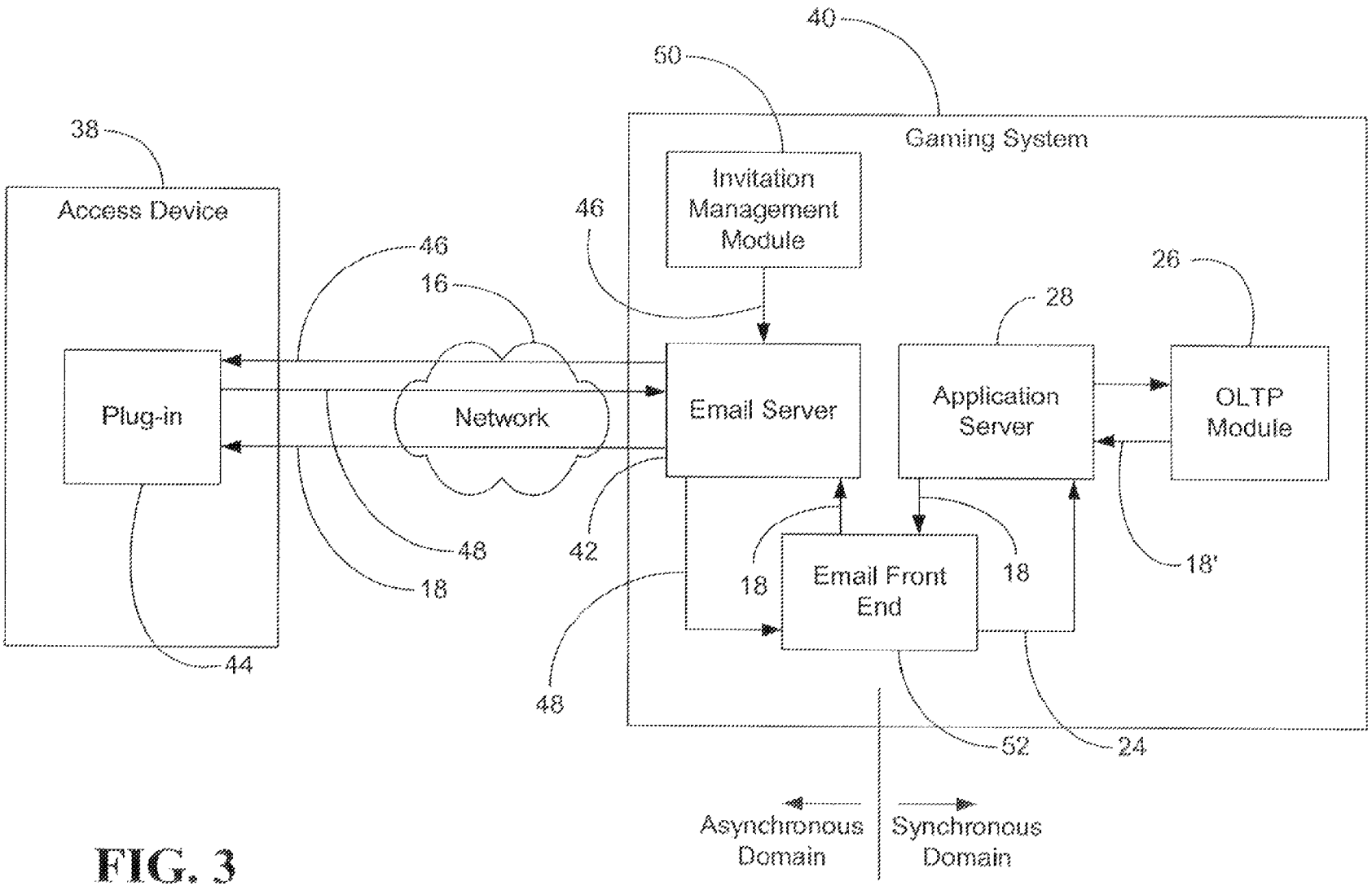
FIG. 3 is a block diagram of a gaming system according to a second alternative embodiment of the present invention.

Turning now to FIG. 3, a gaming system 40 is shown, wherein an email server 42 communicates asynchronously with an email plug-in 44 of an access device 38 according to an email protocol. In such a case, asynchronous invitation 46 includes an email message inviting the user to participate. The email message may sit in the user's inbox until the user wishes to deal with it by generating an asynchronous reply 48. As a result, asynchronous reply 48 can include an email message and may be sent without regard to a particular session. Examples of email protocols include, but are not limited to Simple Mail Transfer Protocol (SMTP, State Transition Diagram/STD 10, Request for Comments/RFC 821), Multipurpose Internet Mail Extensions (MIME, RFC 2045-49), Post Office Protocol, Version 3 (POP3, RFC 1081), and Internet Message Access Protocol (IMAP, Version 4, RFC 2060).

Figure 4:
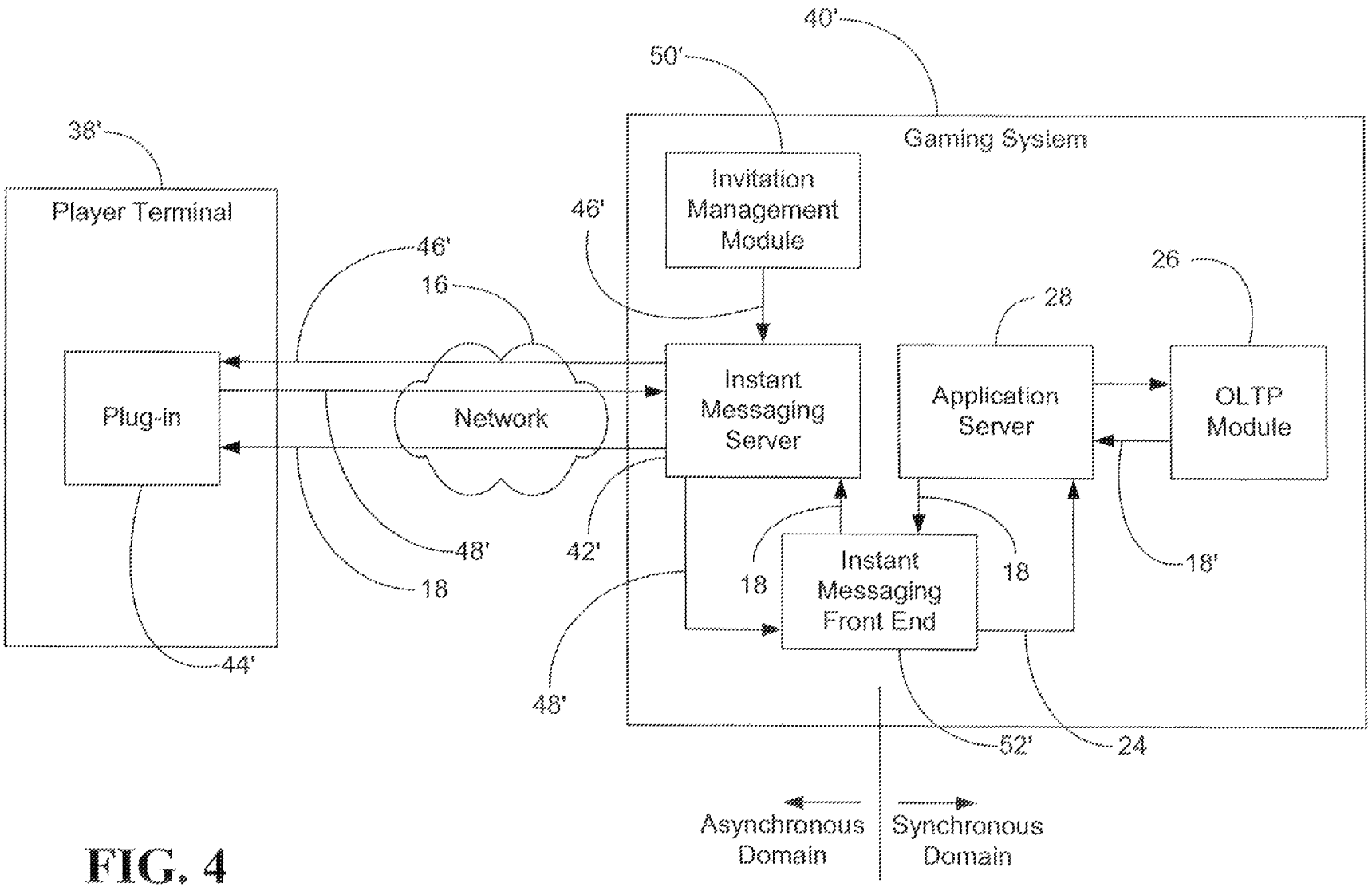
FIG. 4 is a block diagram of a gaming system according to a third embodiment of the present invention.

FIG. 4 shows an alternative gaming system 40' in which the asynchronous messaging server is an IM server 42' that communicates with an IM plug-in 44' of access device 38' over network 16. In such a case, invitation management module 50' generates an asynchronous invitation 46' that includes an instant message. Instant messaging platforms such as AOL® Instant Messenger and Yahoo® Instant Messenger are commercially available and are well documented in the industry. In the illustrated example, the asynchronous reply 48' includes an instant message. Instant messaging front end 52' converts between the instant messaging asynchronous domain and the synchronous domain as already discussed.

Figure 5:
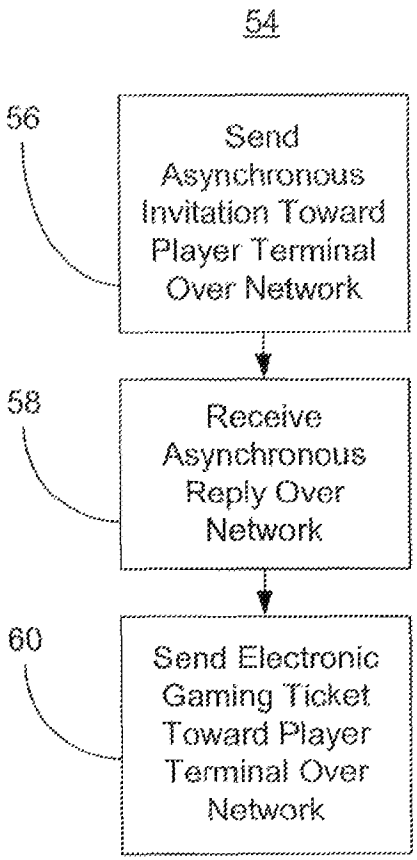
FIG. 5 is a flowchart of a method of generating electronic gaming tickets according to one embodiment of the invention.

Turning now to FIG. 5, a method 54 of generating electronic gaming tickets is shown. Method 54 can be implemented in any combination of commercially available hardware and/or software techniques. For example, method 54 can be implemented as a set of instructions stored in a machine-readable medium such as read only memory (ROM), compact disk. ROM (CD-ROM), magnetic disk, random access memory (RAM), etc., where the instructions are capable of being executed by a processor to generate electronic gaming tickets. Generally, processing block 56 provides for sending an asynchronous invitation toward an access device over a network according to a standalone transaction protocol. An asynchronous reply is received at block 58 from the access device over the network. Block 60 provides for forwarding an electronic gaming ticket toward the access device over the network based on the asynchronous reply.

Figure 6:
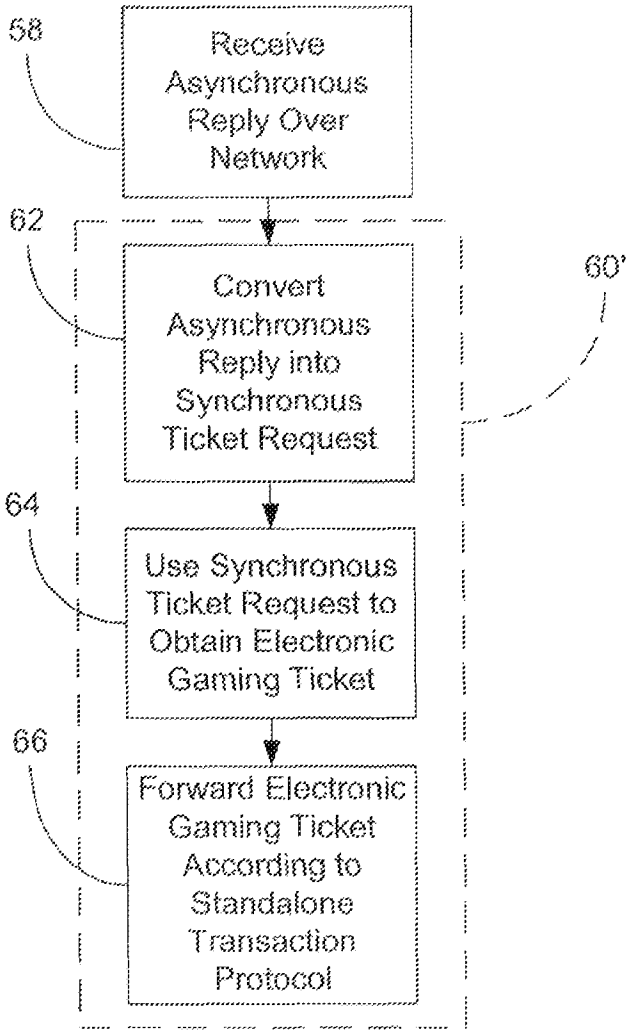
FIG. 6 is a flowchart of a process of sending, an electronic gaming ticket toward a access device according to one embodiment of the invention.

FIG. 6 shows one approach to sending the electronic gaming ticket toward the access device in greater detail at block 60'. Specifically, block 62 provides for converting the asynchronous reply into a synchronous ticket request. The synchronous ticket request is used at block 64 to obtain the electronic gaming ticket. The electronic gaming ticket is forwarded toward the access device at block 66 according to a standalone transaction protocol. As already discussed, the standalone transaction protocol can include protocols such as email protocols and IM protocols. Furthermore, the conversion of the asynchronous reply into the synchronous ticket request can be implemented according to a session-based transaction protocol such as a proprietary OLTP protocol. By formatting the electronic gaming ticket with a markup language such as XML, electronic delivery of the gaming ticket can be implemented in a standardized format.

Figures 7, 8:
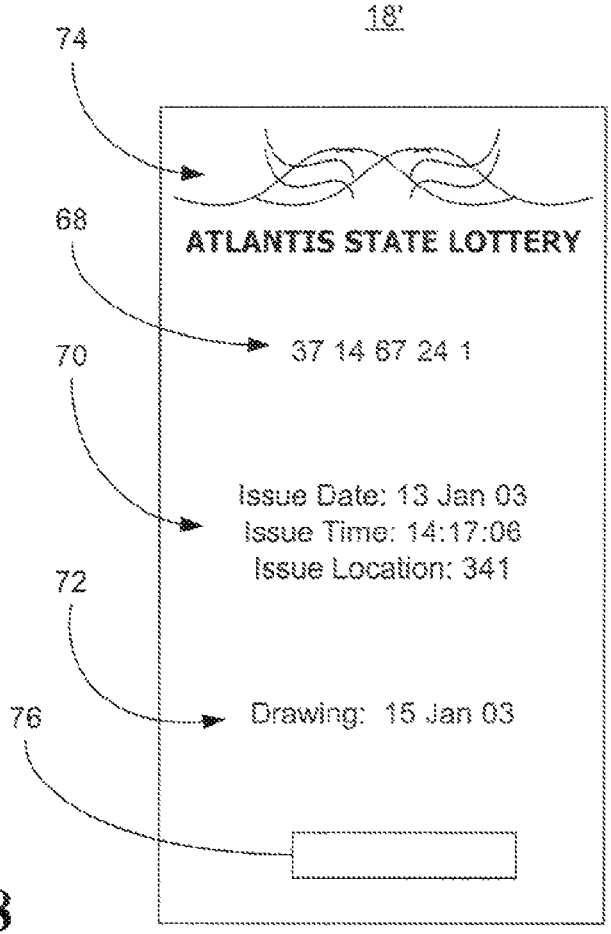
FIG. 7 is a diagram of an asynchronous invitation according to one embodiment of the invention.
FIG. 8 is a diagram of an electronic gaming ticket according to one embodiment of the invention.

FIG. 7 shows one example of an asynchronous invitation 32' in greater detail. In the illustrated example, asynchronous invitation 32' is formatted as an email message. The asynchronous 32' includes an invitation to participate in a future draw lottery game. The asynchronous invitation 32' also includes an invitation identifier 33 so that the asynchronous reply can be matched to the correct invitation. The invitation 32' may also include hypertext 35, which when clicked on will "explode" into a play slip or a representation of the electronic gaming ticket.

Turning now to FIG. 8, one type of electronic gaming ticket is shown at 18. The illustrated electronic gaming ticket 18 is a future draw lottery ticket having drawing numbers 68, and issue information 70 and drawing information 72. In addition, the electronic gaming ticket 18 has graphical information such as logo 74, which can be described in a standardized image file format. The ticket 18 also has a validation code 76, which enables the ticket 18 to be validated if presented for redemption. Thus, the marked up version of ticket 18 can relay all the necessary information to the access device plug-in to enable complete reproduction of the ticket 18 for the user.

Those skilled in the art can appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A gaming system, comprising:

an email server configured to send an asynchronous invitation to play a wagering game toward an access device over a network according to an email protocol; and an asynchronous messaging server, the asynchronous messaging server adapted to receive an asynchronous reply to the invitation from the access device over the network and send an electronic gaming ticket for the wagering game toward the access device over the network using the email protocol, the electronic gaming ticket based on the asynchronous reply.

2. The gaming system of claim 1, further comprising a conversion front end coupled to the asynchronous messaging server, the conversion front end configured to convert the asynchronous reply into a synchronous ticket request and use the synchronous ticket request to obtain the electronic gaming ticket.

3. The gaming system of claim 2, wherein the conversion front end is configured to convert the asynchronous reply into the synchronous ticket request according to a session-based transaction protocol.

4. The gaming system of claim 2, wherein the conversion front end is configured to format the electronic gaming ticket with a markup language.

5. The gaming system of claim 1, further comprising:

an online transaction processing (OLTP) module, the OLTP module configured to generate the electronic gaming ticket; and an application server coupled to the conversion front end and the OLTP module, the application server configured to retrieve the electronic gaming ticket from the OLTP module according to the session-based transaction protocol.

6. The gaming system of claim 1, wherein the electronic gaming ticket is a lottery ticket.

7. The gaming system of claim 1, wherein lottery ticket is a future draw lottery ticket for which the outcome has not yet been determined.

8. The gaming system of claim 7, wherein the future draw lottery ticket has drawing numbers that are defined by the asynchronous reply.

9. The gaming system of claim 7, wherein the future draw lottery ticket has drawing numbers that are defined by an online transaction processing (OLTP) module.

10. The gaming system of claim 1, further comprising an invitation management module coupled to the asynchronous messaging server, the invitation management module configured to generate an asynchronous invitation to participate in a lottery.

11. The gaming system of claim 1, wherein the asynchronous messaging server is configured to send a plurality of electronic gaming tickets toward a plurality of access devices over the network based on a plurality of asynchronous replies.

12. The gaming system of claim 1, wherein the gaming ticket is associated with a wager, and the asynchronous messaging server sends the electronic gaming ticket before an outcome of the wager is determined by the game operator.

13. The gaming system of claim 1, wherein the access device is a personal computer, personal digital assistant, cellular phone or other computing device.

14. A gaming system, comprising:

an instant messaging server configured to send an asynchronous invitation to play a wagering game toward an access device over a network according to an instant messaging protocol; and an asynchronous messaging server, the asynchronous messaging server adapted to receive an asynchronous reply to the invitation from the access device over the network and send an electronic gaming ticket for the wagering game toward the access device over the network using the instant messaging protocol, the electronic gaming ticket based on the asynchronous reply.

15. The gaming system of claim 14, further comprising:

a conversion front end coupled to the asynchronous messaging server, the conversion front end configured to convert the asynchronous reply into a synchronous ticket request and use the synchronous ticket request to obtain the electronic gaming ticket.

16. The gaming system of claim 15, wherein the conversion front end is configured to convert the asynchronous reply into the synchronous ticket request according to a session-based transaction protocol.

17. The gaming system of claim 15, wherein the conversion front end is configured to format the electronic gaming ticket with a markup language.

18. The gaming system of claim 14, further comprising:

an online transaction processing (OLTP) module, the OLTP module configured to generate the electronic gaming ticket; and an application server coupled to the conversion front end and the OLTP module, the application server configured to retrieve the electronic gaming ticket from the OLTP module according to the session-based transaction protocol.

19. The gaming system of claim 14, wherein the electronic gaming ticket is a lottery ticket.

20. The gaming system of claim 14, wherein lottery ticket is a future draw lottery ticket for which the outcome has not yet been determined.

21. The gaming system of claim 14, wherein the future draw lottery ticket has drawing numbers that are defined by the asynchronous reply.

22. The gaming system of claim 14, wherein the future draw lottery ticket has drawing numbers that are defined by an online transaction processing (OLTP) module.

23. The gaming system of claim 14, further comprising an invitation management module coupled to the asynchronous messaging server, the invitation management module configured to generate an asynchronous invitation to participate in a lottery.

24. The gaming system of claim 14, wherein the asynchronous messaging server is configured to send a plurality of electronic gaming tickets toward a plurality of access devices over the network based on a plurality of asynchronous replies.

25. The gaming system of claim 14, wherein the gaming ticket is associated with a wager, and the asynchronous messaging server sends the electronic gaming ticket before an outcome of the wager is determined by the game operator.

26. The gaming system of claim 14, wherein the access device is a personal computer, personal digital assistant, cellular phone or other computing device.

* * * * *